US008783505B2

(12) United States Patent
Yourist

(10) Patent No.: US 8,783,505 B2
(45) **Date of Patent: *Jul. 22, 2014**

(54) RETORTABLE PLASTIC CONTAINERS

(75) Inventor: Sheldon E. Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/483,249

(22) Filed: May 30, 2012

(65) Prior Publication Data

US 2013/0320029 A1 Dec. 5, 2013

(51) Int. Cl.

| | |
|---|---|
| ***B65D 6/38*** | (2006.01) |
| ***B65D 6/34*** | (2006.01) |
| *B65D 1/44* | (2006.01) |

(52) U.S. Cl.

CPC ..... *B65D 11/26* (2013.01); *B65D 11/24* (2013.01); *B65D 1/44* (2013.01)

USPC ..... 220/675; 220/669; 220/646

(58) Field of Classification Search

CPC ..... B65D 1/44; B65D 1/42; B65D 1/40; B65D 11/26; B65D 11/24; B65D 11/22; B65D 11/20

USPC ..... 220/646, 672, 675, 670, 669, 659, 657, 220/656; 215/383, 382

See application file for complete search history.

(56) References Cited

U.S. PATENT DOCUMENTS

| | | | | |
|---|---|---|---|---|
| D67,464 | S | 6/1925 | Johnson | |
| D200,443 | S | 2/1965 | Deegan | |
| D201,400 | S | 6/1965 | Kneeland | |
| 3,268,109 | A * | 8/1966 | Coppens | 220/672 |
| D205,686 | S | 9/1966 | Marchant | |
| 3,357,593 | A | 12/1967 | Sears, Jr. et al. | |
| 3,685,685 | A | 8/1972 | Philips | |
| D232,080 | S | 7/1974 | Strand | |
| 4,102,467 | A | 7/1978 | Woodley | |
| D277,041 | S | 1/1985 | Nichols | |
| 4,840,289 | A | 6/1989 | Fait et al. | |
| 4,880,129 | A | 11/1989 | McHenry et al. | |
| 4,890,759 | A | 1/1990 | Scanga | |
| 4,948,006 | A | 8/1990 | Okabe et al. | |
| 4,997,691 | A | 3/1991 | Parkinson | |
| 5,054,632 | A | 10/1991 | Alberghini et al. | |
| 5,071,029 | A | 12/1991 | Umlah et al. | |

(Continued)

FOREIGN PATENT DOCUMENTS

| | | |
|---|---|---|
| GB | 2161133 A | 1/1986 |
| WO | 02074635 A1 | 9/2002 |

OTHER PUBLICATIONS

International Search Report for International Application No. PCT/US2011/029014 dated Aug. 22, 2011.

(Continued)

*Primary Examiner* — Robert J Hicks
(74) *Attorney, Agent, or Firm* — Baker Botts L.L.P.

(57) ABSTRACT

A plastic container includes a sidewall defining a bottom portion, a main body portion and an upper rim. The main body portion of the sidewall has at least one groove defined therein that has a circumferential component. Reinforcement structure is provided on the portion of the sidewall that defines the groove for limiting vertical expansion and contraction of the main body portion in response to force that is applied to the sidewall.

37 Claims, 11 Drawing Sheets

(56) References Cited

U.S. PATENT DOCUMENTS

| | | | | |
|---|---|---|---|---|
| D323,290 | S | 1/1992 | Keedy | |
| D324,493 | S | 3/1992 | Nickerson | |
| 5,217,737 | A | 6/1993 | Gygax et al. | |
| 5,234,126 | A | 8/1993 | Jonas et al. | |
| D354,200 | S | 1/1995 | Grappolini | |
| 5,718,352 | A | 2/1998 | Diekhoff et al. | |
| 5,730,315 | A * | 3/1998 | Richoux | 220/672 |
| 5,746,339 | A | 5/1998 | Petre et al. | |
| 6,095,360 | A | 8/2000 | Shmagin et al. | |
| 6,230,912 | B1 * | 5/2001 | Rashid | 215/383 |
| D454,190 | S | 3/2002 | Trocola | |
| D469,351 | S | 1/2003 | Huang | |
| 6,520,362 | B2 | 2/2003 | Heisel et al. | |
| D482,571 | S | 11/2003 | Leinenweber | |
| D485,182 | S | 1/2004 | Gaydon | |
| D515,927 | S | 2/2006 | Smay et al. | |
| D523,347 | S | 6/2006 | Livingston | |
| 7,055,713 | B2 | 6/2006 | Rea et al. | |
| 7,178,687 | B1 | 2/2007 | Manderfield, Jr. et al. | |
| D545,684 | S | 7/2007 | DeMaso et al. | |
| D547,667 | S | 7/2007 | DeMaso et al. | |
| D551,026 | S | 9/2007 | Morgan et al. | |
| D559,120 | S | 1/2008 | Farrow et al. | |
| D559,121 | S | 1/2008 | Farrow et al. | |
| D608,203 | S | 1/2010 | Yourist | |
| D625,202 | S | 10/2010 | Yourist | |
| D632,590 | S | 2/2011 | Peacock | |
| D634,635 | S | 3/2011 | Araujo et al. | |
| D653,543 | S | 2/2012 | Yourist et al. | |
| D653,544 | S | 2/2012 | Yourist et al. | |
| D653,545 | S | 2/2012 | Yourist et al. | |
| 8,365,945 | B2 * | 2/2013 | Yourist | 220/669 |
| 2004/0149677 | A1 * | 8/2004 | Slat et al. | 215/380 |
| 2004/0211746 | A1 | 10/2004 | Trude et al. | |
| 2006/0157438 | A1 * | 7/2006 | Livingston et al. | 215/381 |
| 2009/0166314 | A1 | 7/2009 | Matsuoka | |
| 2010/0012618 | A1 * | 1/2010 | Boukobza | 215/383 |
| 2010/0301003 | A1 * | 12/2010 | Lewis et al. | 215/384 |
| 2011/0017753 | A1 * | 1/2011 | Lewis et al. | 220/669 |
| 2011/0226787 | A1 | 9/2011 | Yourist | |
| 2011/0226788 | A1 | 9/2011 | Yourist | |
| 2012/0312826 | A1 * | 12/2012 | Yourist | 220/669 |

OTHER PUBLICATIONS

Gilpin and Company, Inc. Plastic Packaging. Retrieved from www.gilpinezo.com/offers.html.

* cited by examiner

RETORTABLE PLASTIC CONTAINERS

BACKGROUND OF THE INVENTION

1. Field of the Invention

This invention relates generally to the field of plastic containers that are adapted to be heat sterilized. More specifically, the invention relates to an improved retortable container that is more dimensionally stable during the sterilization process than conventional predecessor containers.

2. Description of the Related Technology

Certain products require sterilization during the packaging process in order to inhibit the growth of bacteria. Products requiring sterilization include foods such as milk, yogurt and various sauces, as well as certain pharmaceutical products. Thermal processing, sterilization, canning and retorting are all terms referring to the process of taking a food product, already sealed in its container, and heating it to a specific temperature for a specific time. The objective is to kill spoilage organisms and pathogenic bacteria, thus preserving the food and allowing it to be stored unrefrigerated for extended lengths of time.

There are multiple designs for retorting food containers, including batch systems and continuous systems. In a batch system, containers are placed in crates or baskets, which are then loaded into a vessel into which the heating medium is introduced. This method is the oldest and most traditional and also the most versatile in the range of products and container sizes it can handle. In a continuous retort system, a conveyor is used to continuously transport the containers to be sterilized through a heating chamber that contains the heating medium. There are advantages to each method depending on individual processing operations and, just as important, the type of food being processed.

Traditionally, products that require heat sterilization have been packaged in glass containers, which are relatively stable at elevated temperatures and pressures. However, in recent years plastic retortable containers have come into use. Plastic containers tend to be less expensive than glass containers and safer in many respects because they will not shatter when dropped.

The temperatures of the retort process are elevated enough to temporarily increase the internal pressurization of the container. Plastic retortable containers accordingly have been designed to permit limited and reversible controlled flexure of one or more surfaces in order to accommodate the internal volumetric changes that are inherent to the retort sterilization process. U.S. Pat. No. 5,217,737 to Gygax et al. discloses a retortable plastic container that has a flexible bottom portion to accommodate internal volumetric changes. Other retortable containers that have been in commercial use have a champagne style bottom portion that is designed to permit a certain amount of flexure. However, when using a continuous retort process the flexure of retortable plastic containers must be limited so that it will not interfere with the process of conveying the container through the continuous retort system. Typically, such conveyors require at least two dimensionally stable points of contact on the container.

In designing such containers, the sidewall must be formed of a sufficient thickness to provide the requisite strength and stability. However, because of the significant expense of plastic resin when such containers are being produced on a commercial scale, keeping the containers as lightweighted as possible is also an important consideration. These two design factors are obviously in tension with each other. Any improvements to retortable container designs that would tend to enhance strength and stability without significantly adding to material costs would be appreciated by those skilled in this area of technology as an important advance.

A need accordingly exists for an improved retortable container that exhibits improved dimensional stability and strength during the retort process without significantly adding to material costs.

SUMMARY OF THE INVENTION

Accordingly, it is an object of the invention to provide an improved retortable container that exhibits improved dimensional stability and strength during the retort process without significantly adding a material costs.

In order to achieve the above and other objects of the invention, a retortable plastic container that is constructed according to a first aspect of the invention includes a mounting portion that is adapted to have a lid mounted thereto and a main body portion having a sidewall. The sidewall is shaped to define a curved outer surface that defines a maximum outer width of the container. The main body portion has a groove defined therein substantially at a location that defines the maximum outer width of the container.

A retortable plastic container according to a second aspect of the invention includes a main body portion having a sidewall that is fabricated from a plastic material; and a mounting portion that is adapted to have a lid mounted thereto. The mounting portion includes a substantially vertical sidewall portion that is unitary with the sidewall of the main body portion. The substantially vertical sidewall portion has a first outer radius and a mounting flange that extends upwardly and outwardly at a first angle from the substantially vertical sidewall portion. The mounting flange also has a second outer radius that is greater than the first outer radius.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
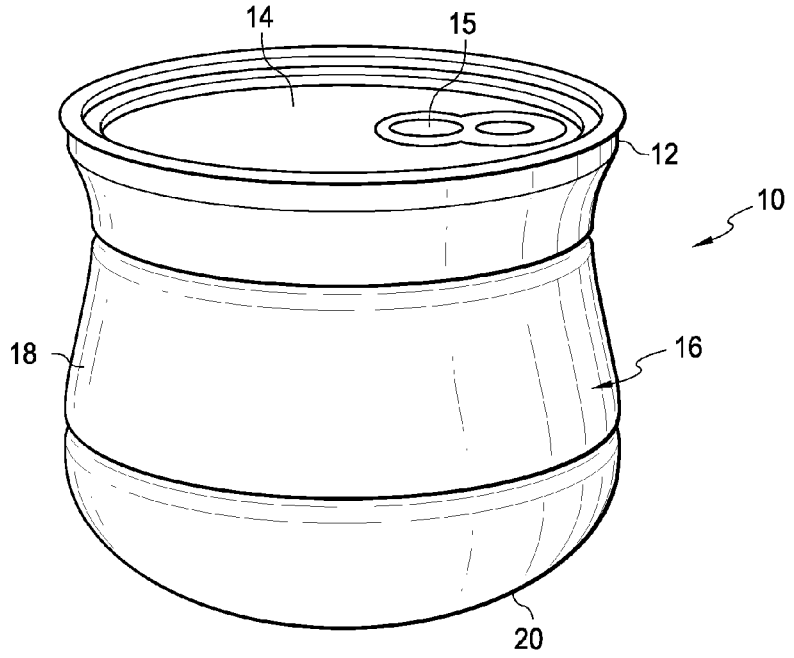
FIG. 1 is a perspective view of a retortable plastic container that is constructed according to a first embodiment of the invention.

Referring now to the drawings, wherein like reference numerals designate corresponding structure throughout the views, and referring in particular to FIG. 1, a retortable plastic container 10 that is constructed according to a preferred embodiment of the invention includes a mounting portion 12 that is adapted to have lid 14 mounted thereto. Plastic container 10 also preferably includes a main body portion 16 having a sidewall 18.

Figure 6:
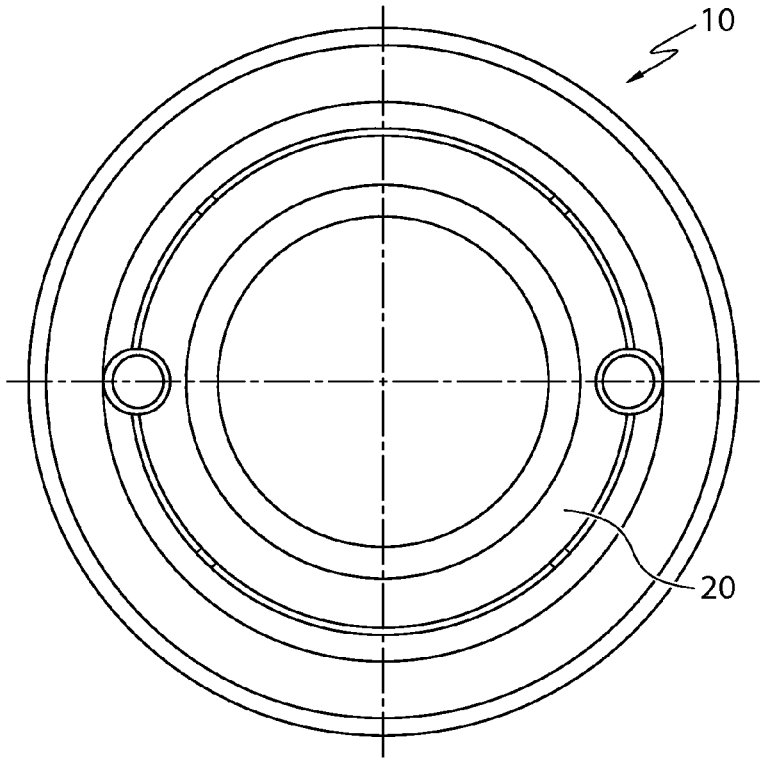
FIG. 6 is a bottom plan view of the plastic container that is shown in FIG. 1.

The sidewall 18 is preferably fabricated from a plastic material that has the requisite characteristics for withstanding the retort process, such as a multi-layer material including polypropylene. The sidewall 18 also defines a bottom portion 20, best shown in FIG. 6, which is configured to support the container 10 on a flat horizontal underlying surface.

The lid 14 is preferably fabricated from a metallic material such as steel or aluminum, and may be an easy open type lid having a pull tab 15.

Figure 2:
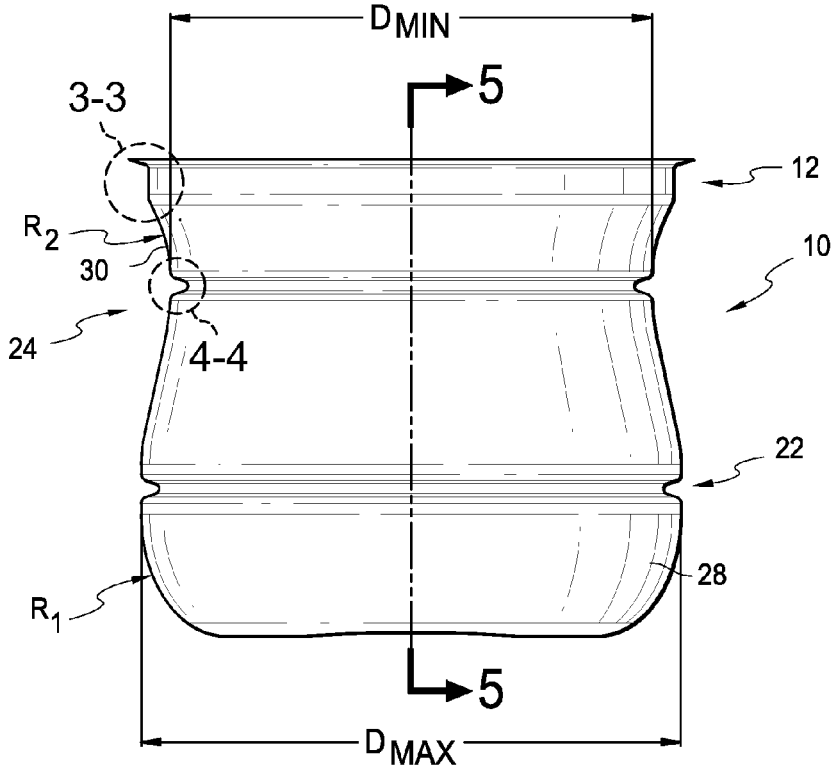
FIG. 2 is a side elevational view of the plastic container that is shown in FIG. 1.
Figure 5:
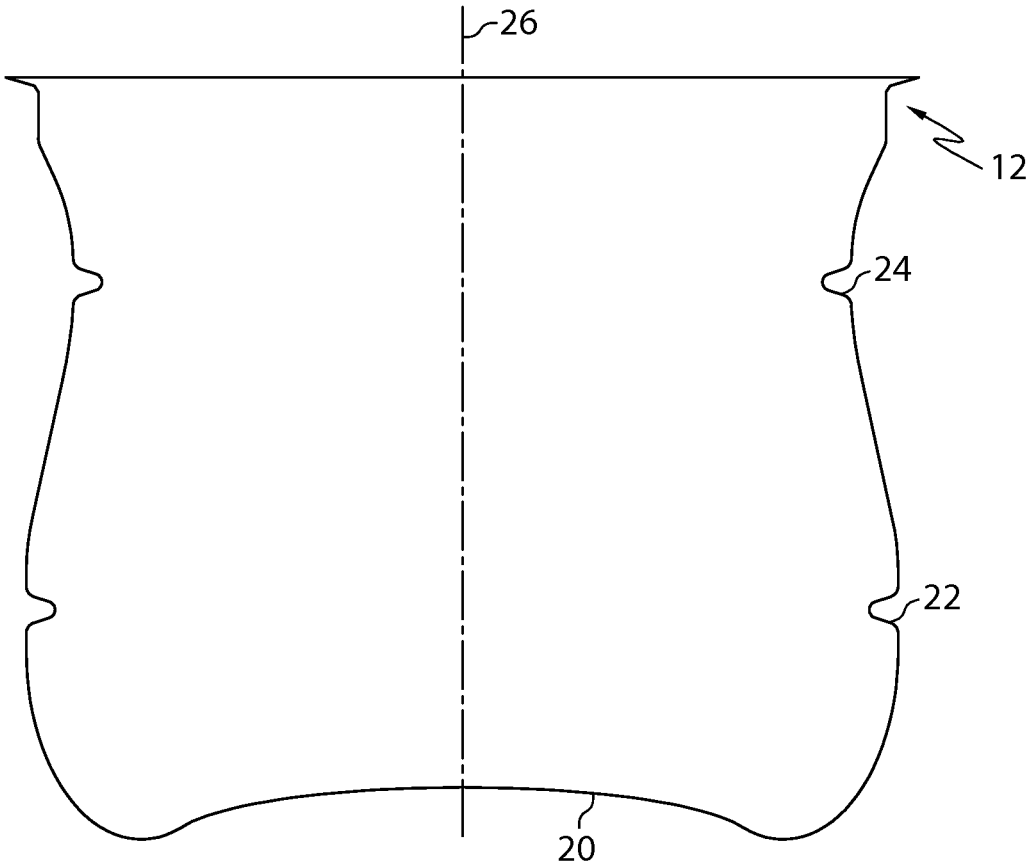
FIG. 5 is a cross-sectional view taken along lines 5-5 in FIG. 2.

The main body portion 16 of the container 10 is preferably constructed so as to be substantially symmetrical about a longitudinal axis 26, as is best shown in FIG. 5. The main body portion 16 includes a curved outer portion that defines a maximum outer width $D_{MAX}$ of the container 10 and a minimum outer width $D_{MIN}$, as is best shown in FIG. 2. In the preferred embodiment, the curved outer portion includes a convexly curved lower portion 28 having a first radius $R_1$ that defines the maximum outer width of the container 10 and a concavely curved upper portion 30 having a second radius $R_2$ that defines the minimum outer width $D_{MIN}$.

A first groove 22 is preferably defined in the sidewall 18 substantially at a location that defines the maximum outer width of the container. In addition, a second groove 24 is defined in the sidewall 18 at a location that defines the minimum outer width of the container.

Both the first groove 22 and the second groove 24 preferably extend substantially within a horizontal plane about an entire circumference of the main body portion 16. Moreover, in the preferred embodiment, the first and second grooves 22, 24 are substantially identical in size and shape as viewed in longitudinal cross-section, as shown in FIG. 5.

Figure 7:
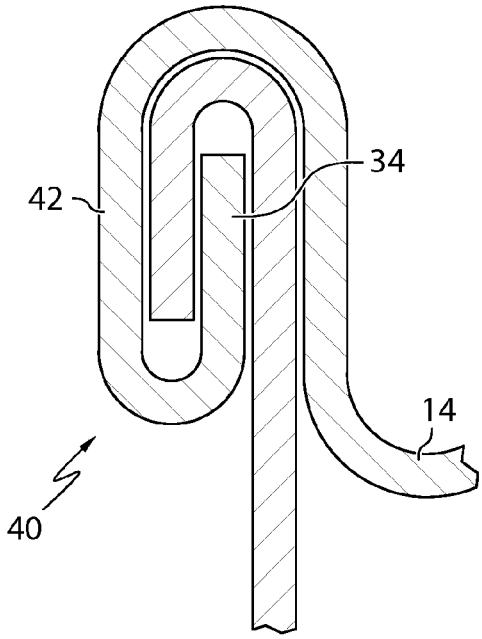
FIG. 7 is a fragmentary cross-sectional view depicting a portion of the plastic container that is shown in FIG. 1.

The purpose of the first and second grooves 22, 24 is to provide dimensional stability to the container 10 during the retort process, and in particular to provide at least two dimensionally stable points of contact for the conveying apparatus in a continuous retort system. In the preferred embodiment, the two dimensionally stable points of contact are the location of the maximum outer width $D_{MAX}$ and the maximum outer width of the lid 14, which occurs at an end curl portion 42, best shown in FIG. 7.

Figure 4:
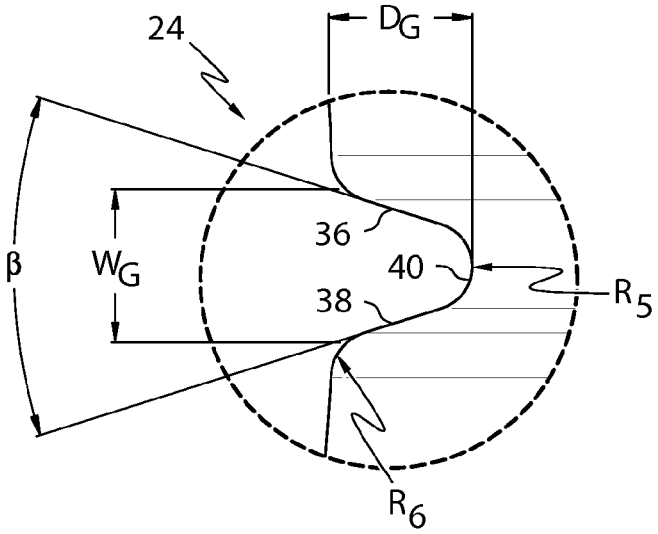
FIG. 4 is an enlarged portion of the area indicated by circle 4-4 in FIG. 2.

FIG. 4 is an enlargement of a portion of FIG. 1 showing the details of the second groove 24. As FIG. 4 shows, the second groove 24 is defined by a first sidewall portion 36, a second sidewall portion 38 that is angled with respect to the first sidewall portion 36 at an angle β, and a bottom portion 40. The bottom 40 of the second groove 24 preferably has a concave shape that is radiused at a radius $R_5$ that is preferably substantially within a range of about 0.024 to about 0.044 inch.

The angle β is preferably substantially within a range of about 20° to about 40° and more preferably substantially within a range of about 25° to about 35°. The second groove 24 also preferably has a maximum depth $D_G$ that is preferably substantially within a range of about 0.074 inch to about 0.134 inch, and more preferably substantially within a range of about 0.084 inch to about 0.124 inch. The second groove 24 further preferably has a maximum width $W_G$ it is preferably substantially within a range of about 0.078 inch to about 0.138 inch, and more preferably substantially within a range about 0.088 inch to about 0.128 inch.

Figure 3:
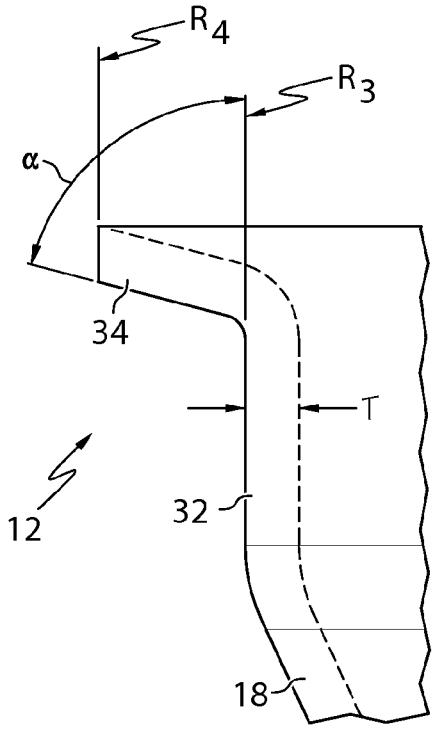
FIG. 3 is a fragmentary diagrammatical depiction of a portion of the plastic container that is shown in the area indicated by circle 3-3 in FIG. 2.

Referring now to FIG. 3, it will be seen that the mounting portion 12 includes a substantially vertical sidewall portion 32 that is unitary with the sidewall 18 of the main body portion 16, and a mounting flange 34 that extends upwardly and outwardly at a first angle α from the substantially vertical sidewall portion 32. The substantially vertical sidewall portion 32 defines a first outer radius $R_3$, and the mounting flange 34 defines a second outer radius $R_4$ that is greater than the first outer radius $R_3$.

A difference between the second outer radius $R_4$ and the first outer radius $R_3$, which represents the width of the mounting flange 34 as viewed in longitudinal cross-section, is preferably substantially within a range of about 0.06 inch to about 0.18 inch. More preferably, the difference between the second outer radius and the first outer radius is substantially within a range of about 0.09 inch to about 0.15 inch.

A ratio $R_3/R_4$ is preferably substantially within a range of about 0.865 to about 0.985, more preferably substantially within a range of about 0.875 to about 0.975 and most preferably substantially within a range of about 0.885 to about 0.965.

The first angle α is preferably substantially within a range of about 55° to about 85°, and more preferably substantially within a range of about 65° to about 85°.

The sidewall 18 as well as the substantially vertical sidewall portion 32 preferably has a thickness T that is substantially within a range of about 0.01 inch to about 0.05 inch, and more preferably substantially within a range of about 0.02 inch to about 0.035 inch.

Figure 8:
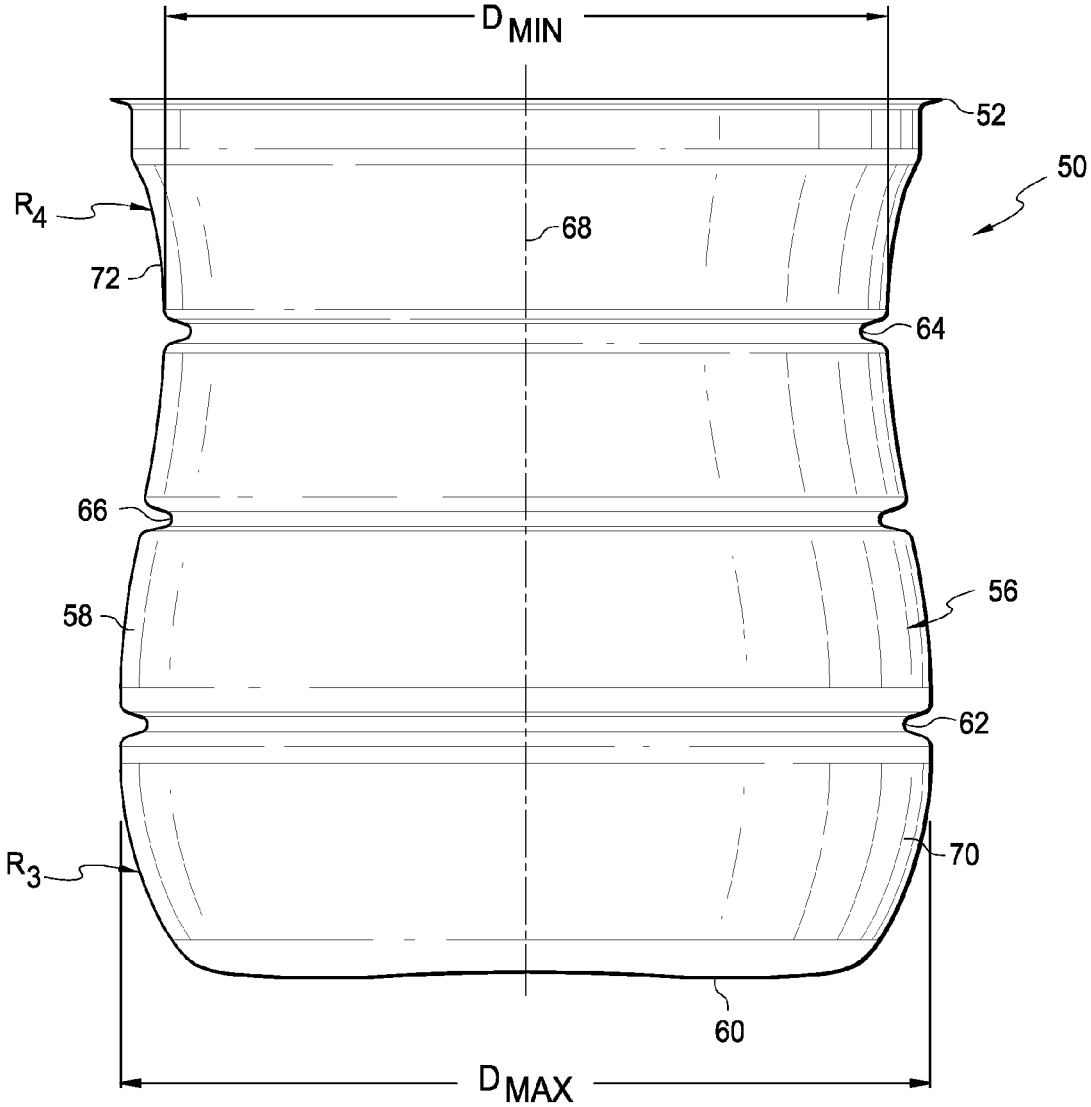
FIG. 8 is a side elevational view of a plastic container that is constructed according to a second embodiment of the invention.

As shown in FIG. 8, a retortable plastic container 50 that is constructed according to a preferred second embodiment of the invention includes a mounting portion 52 that is adapted to have a lid 14 mounted thereto in the manner described above with respect to the first embodiment of the invention. Mounting portion 52 is preferably substantially identical in function and shape to the mounting portion 12 that has been described with respect to the first embodiment.

Plastic container 50 also preferably includes a main body portion 56 having a sidewall 58. The sidewall 58 is preferably fabricated from a plastic material that has the requisite characteristics for withstanding the retort process, such as polypropylene. The sidewall 58 also defines a bottom portion 60, best shown in FIG. 6, which is configured to support the container 50 on a flat horizontal underlying surface.

The main body portion 56 of the container 50 is preferably constructed so as to be substantially symmetrical about a longitudinal axis 68, as is best shown in FIG. 8. The main body portion 56 includes a curved outer portion that defines a maximum outer width $D_{MAX}$ of the container 50 and a minimum outer width $D_{MIN}$. In the preferred embodiment, the curved outer portion includes a convexly curved lower portion 70 having a first radius $R_3$ that defines the maximum outer width of the container 50 and a concavely curved upper portion 72 having a second radius $R_4$ that defines the minimum outer width $D_{MIN}$.

A first groove 62 is preferably defined in the sidewall 58 substantially at a location that defines the maximum outer width of the container 50. A second groove 64 is also defined in the sidewall 58 at a location that defines the minimum outer width of the container 50. In addition, a third groove 66 is defined in a portion of the sidewall 58 that represents a transition between the convexly curved lower portion 70 and the concavely curved upper portion 72, between the location of the first groove 62 and the second groove 64.

The first groove 62, the second groove 64 and the third groove 66 each preferably extends substantially within a horizontal plane about an entire circumference of the main body portion 56. Moreover, in the preferred embodiment, the first, second and third grooves 62, 64, 66 are substantially identical in size and shape as viewed in longitudinal cross-section, as shown in FIG. 8.

The purpose of grooves 62, 64, 66 is to provide dimensional stability to the container 50 during the retort process, and in particular to provide at least two dimensionally stable points of contact for the conveying apparatus in a continuous retort system. In the preferred embodiment, the two dimensionally stable points of contact are the location of the maximum outer width $D_{MAX}$ and the maximum outer width of the lid 14 that is mounted to the mounting portion 52, which occurs at an end curl portion 42, best shown in FIG. 7.

The container 50 provides superior dimensional stability during the retort process in comparison with the container 10, because of the additional reinforcement that is provided by the presence of the third groove 66.

Referring now to FIGS. 9-17, a container 80 that is constructed according to a third, preferred embodiment of the invention includes a sidewall 84 that defines a bottom portion 86, a main body portion 88 and an upper rim 90 that has a mounting portion 82. Container 80 in the preferred embodiment is constructed so as to be retortable, but in alternative embodiments could be fabricated from a plastic material that does not possess the characteristics required for withstanding the retort or other heat sterilization process.

The sidewall 84 is accordingly preferably fabricated from a plastic material that has the requisite characteristics for withstanding the retort process, such as a multi-layer material including polypropylene that can be formed using an extrusion blowmolding process. Alternatively, sidewall 84 may be fabricated from a material such as PET and formed using a stretch-reheat blowmolding process.

The bottom portion 86 is preferably constructed as described in U.S. patent application Ser. No. 13/347,261, filed Jan. 10, 2012, the entire disclosure of which is hereby incorporated by reference as if set forth fully herein. It includes defines a raised inner portion and at least one substantially flat bottom support surface. The substantially flat bottom support surface is curved and positioned near a radially outermost edge of the bottom when viewed in bottom plan. A groove is defined in the substantially flat bottom support surface. In addition, a first side wall portion that extends upwardly from the radially outermost edge of the bottom is shaped as a truncated cone, giving the bottom portion greater dimensional stability under retort conditions. The container bottom exhibits superior dimensional stability with respect to predecessor designs.

The main body portion 88 is preferably shaped so as to be substantially symmetrical about a longitudinal axis thereof.

Figure 9:
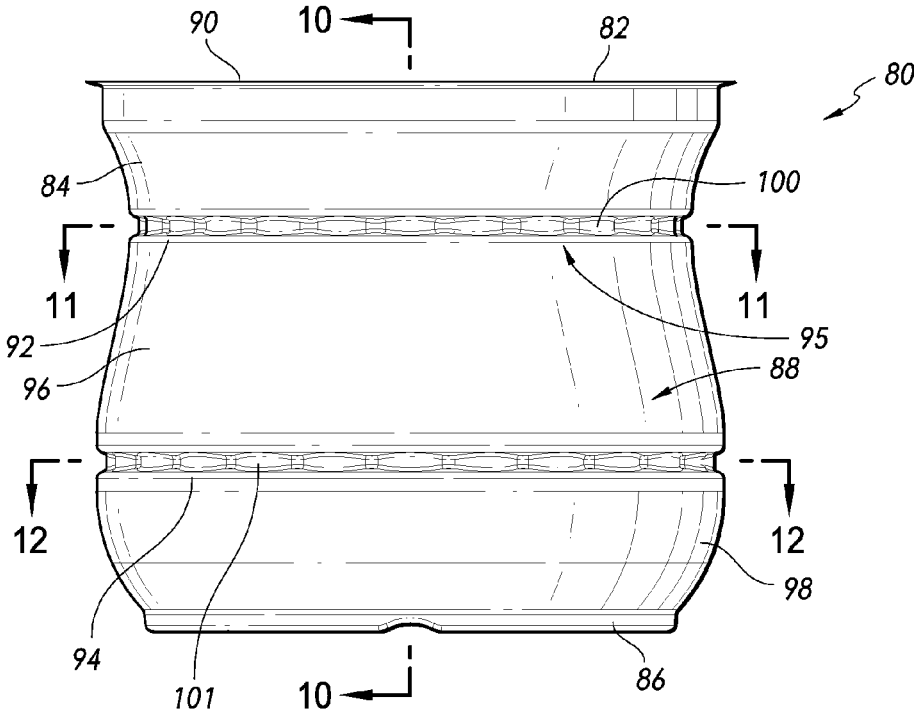
FIG. 9 is a front elevational view of a retortable plastic container that is constructed according to a third preferred embodiment of the invention.

As FIG. 9 shows, the main body portion 88 has at least one groove defined therein that has a circumferential component. In the preferred embodiment, the main body portion 88 has a first groove 92 located at an upper portion of the main body portion 88 and a second groove 94 that is located near a lower portion of the main body portion 88. Second groove 94 is vertically spaced with respect to the first groove 92.

Both the first and second grooves 92, 94 preferably extend about an entire circumference of the container 80, with both the first and second grooves 92, 94 being disposed within a respective substantially horizontal plane. Both the first and second grooves 92, 94 are also preferably shaped so as to be substantially symmetrical about the respective horizontal plane that bisects the groove.

Preferably, at least one of the grooves 92, 94 is provided with reinforcement structure 95 on the portion of the sidewall 84 that defines the groove. In the preferred embodiment, the reinforcement structure 95 is provided within both of the grooves 92, 94 and is configured to limit vertical expansion and contraction, i.e. a "bellows effect," of the main body portion 88 in response to force that is applied to the sidewall 84. Such force may be the result of internal pressurization of the container 80 during the retort process, or top load force caused by stacking of containers during transport or retail display.

The reinforcement structure 95 preferably includes a plurality of flutes 100, 101 provided on the portion of the sidewall 84 that defines the respective groove 92, 94. Each of the flutes 100, 101 preferably has a vertical component, and more preferably is oriented so as to be substantially vertical. The flutes 100, 101 are also preferably spaced substantially evenly about an entire circumference of the respective groove 92, 94. In the preferred embodiment, each of the flutes 100 is of like size and shape, as are each of the flutes 101. As will be described in greater detail below with reference to FIGS. 13 and 16, the depth of both of the grooves 92, 94 will vary about the circumference between a minimum depth $D_1$ that is defined at the peak of each of the flutes and a maximum depth $D_2$ that is defined within a recessed space between the flute peaks.

The sidewall 84 of the main body portion 88 is preferably contoured in an hourglass shape so as to have a first substantially concave portion 96 and a second substantially convex portion 98. In the preferred embodiment, the first substantially concave portion 96 is positioned above the second substantially convex portion 98. Preferably, the first substantially concave portion 96 defines a minimum lateral dimension of the main body portion 88 and the second substantially convex portion 98 defines a maximum lateral dimension $D_{MAX}$ of the main body portion 88.

Figure 11:
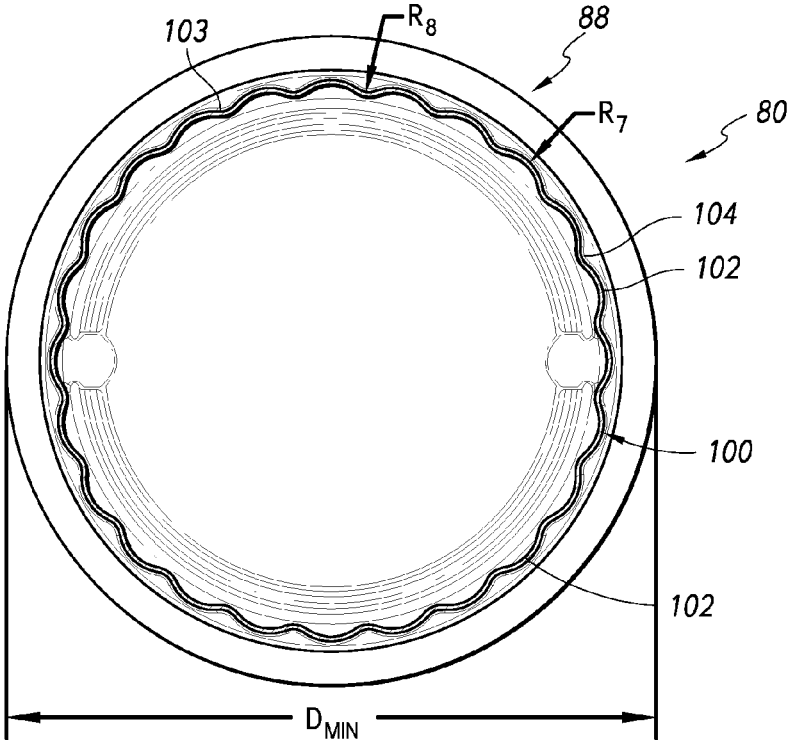
FIG. 11 is a transverse cross-sectional view taken along lines 11-11 in FIG. 9.

FIG. 11 is a transverse cross-sectional view taken in a horizontal plane bisecting the first groove 92. It shows that the reinforcement structure 95 includes a plurality of the flutes 100, each of which is shaped to have a substantially convex portion 102, with substantially concave portions 103 forming a groove bottom being interposed between the respective substantially convex portions 102. Each of the substantially convex portions 102 preferably has an average radius of curvature $R_7$ as viewed in the transverse plane, and each of the substantially concave portions 103 preferably has an average radius of curvature $R_8$ as viewed in the transverse plane. In the preferred embodiment, each of the substantially convex portions 102 preferably has substantially the same size and shape, and each of the substantially concave portions 103 also preferably has substantially the same size and shape.

Figure 12:
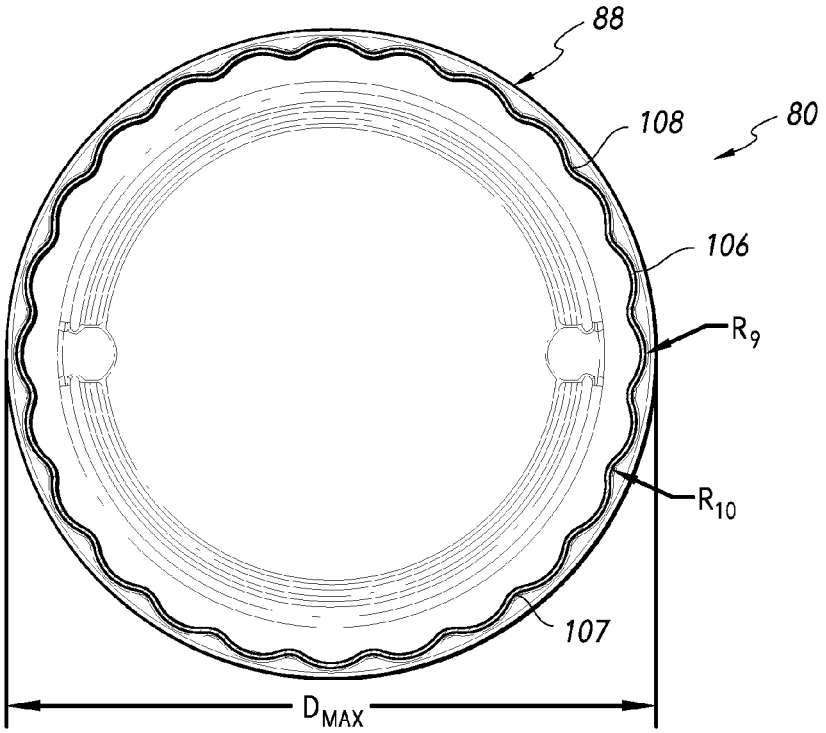
FIG. 12 is a transverse cross-sectional view taken along lines 12-12 in FIG. 9.

FIG. 12 is a transverse cross-sectional view taken in a horizontal plane bisecting the second groove 94. It shows that the reinforcement structure 95 that is provided within the second groove 94 includes a plurality of the flutes 101, each of which is shaped to have a substantially convex portion 106 interposed between adjacent substantially concave portions 107. The substantially convex portions 106 each preferably have an average radius of curvature $R_9$, and the substantially concave portions 107 preferably each have an average radius of curvature $R_{10}$, both viewed in the transverse plane that is shown in FIG. 12.

Figure 10:
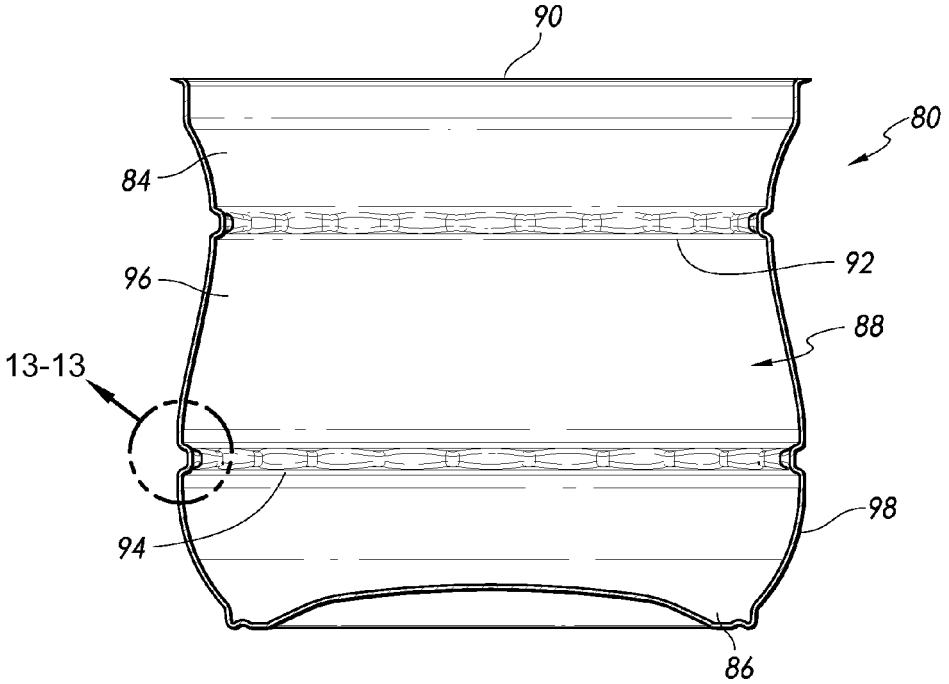
FIG. 10 is a cross-sectional view taken along lines 10-10 in FIG. 9.
Figure 13:
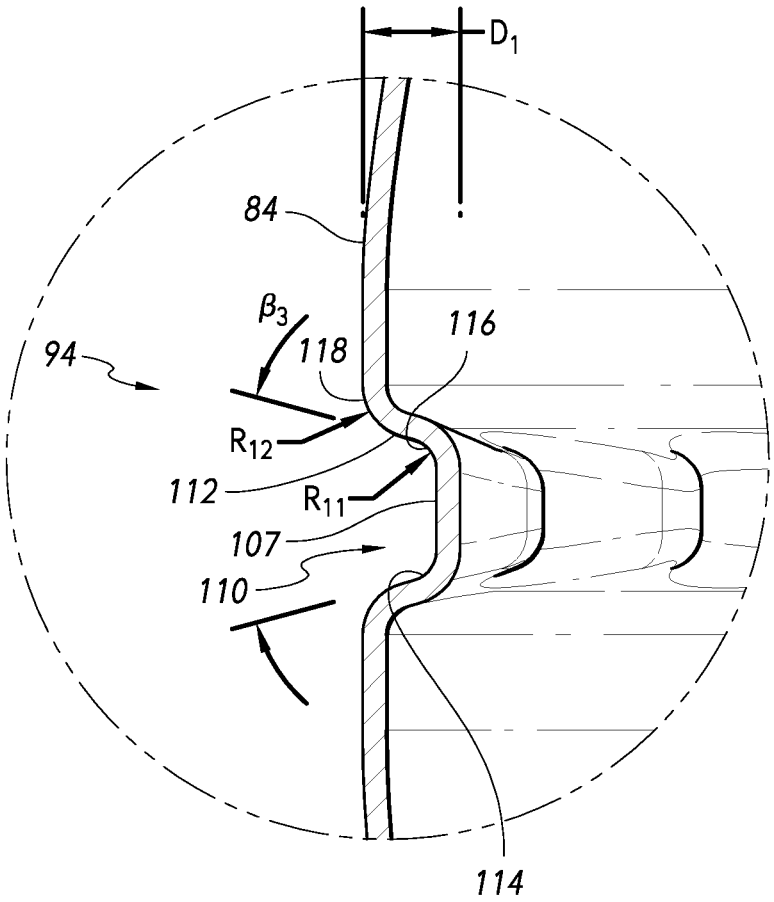
FIG. 13 is an enlarged view of a portion of the container indicated by circle 13-13 in FIG. 10.

FIG. 13 is a fragmentary cross-sectional view taken within a vertical plane showing a portion of the second groove 94, as indicated in FIG. 10. The second groove 94 has a groove bottom 107 that has a location 110 of minimum groove depth $D_1$. The groove 94 has a wedge shape that is defined by a first upper groove sidewall 112 and a second lower groove sidewall 114. The upper and lower sidewalls 112, 114 define a second angle $\beta_3$.

The first upper groove sidewall 112 is preferably connected to the groove bottom 107 by a first concave fillet 116 having a third average radius of curvature $R_{11}$ and to the outer portion of the sidewall 84 by a second convex fillet 118 having a fourth average radius of curvature $R_{12}$. Similarly, the second lower groove sidewall 114 is connected to the groove bottom 107 by a first concave fillet that is preferably substantially symmetrical to the first concave fillet 116 and to the outer portion of the sidewall 84 by a second convex fillet that is preferably substantially symmetrical to the second convex fillet 118.

Figure 14:
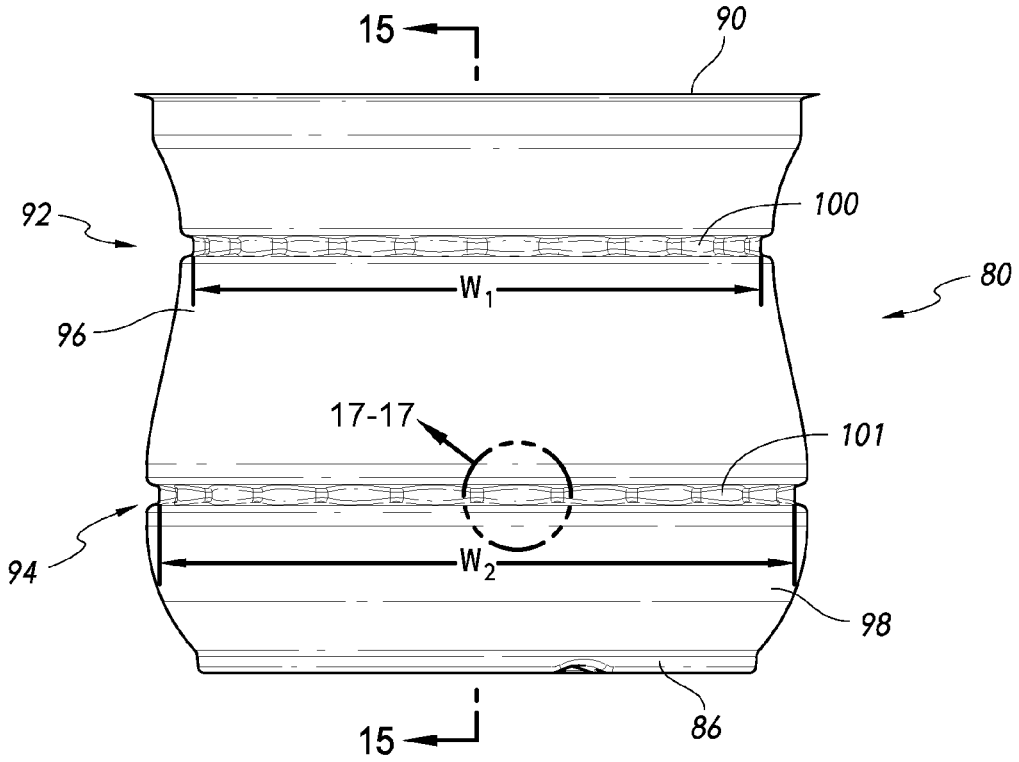
FIG. 14 is a side elevational view of the container that is shown in FIG. 9.
Figure 15:
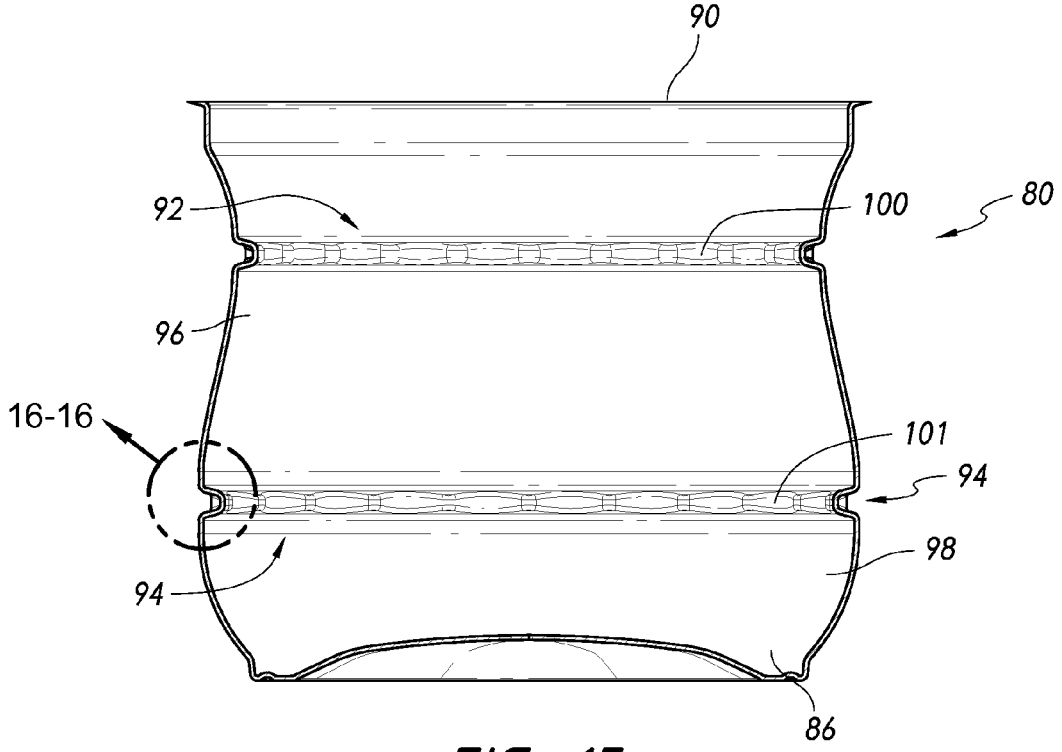
FIG. 15 is a cross-sectional view taken along lines 15-15 in FIG. 14.

FIG. 14 is a side elevational view of the retortable container 80, rotated 90° about the central longitudinal axis with respect to the front elevational view that is shown in FIG. 9. FIG. 15 is a cross-sectional view taken along lines 15-15 in FIG. 14.

Figure 16:
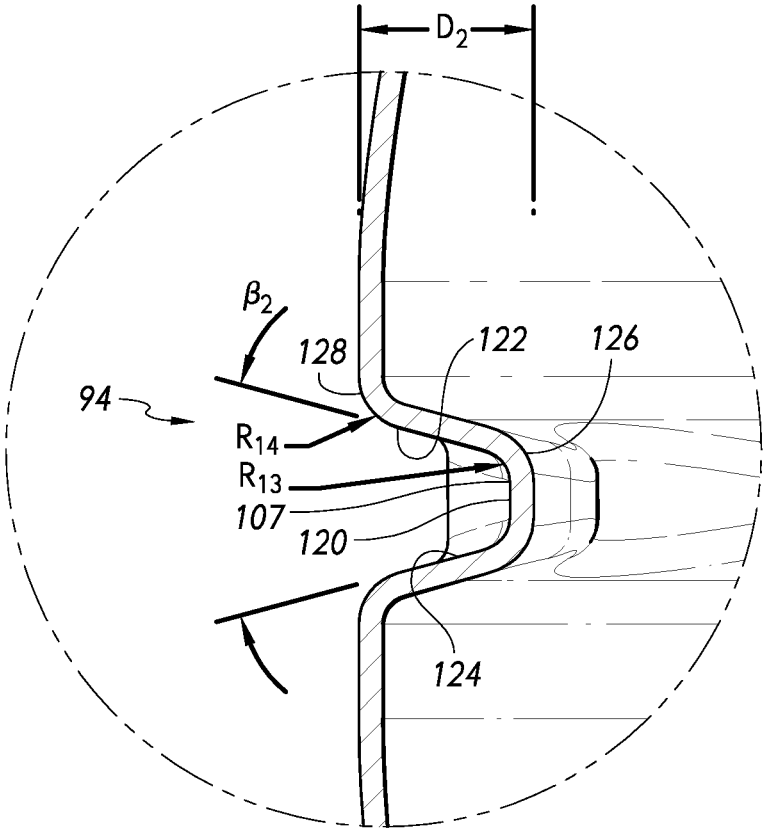
FIG. 16 is an enlarged view of a portion of the container that is indicated by broken line circle 16-16 in FIG. 15.

FIG. 16 is a fragmentary cross-sectional view showing a close up view of a portion indicated by the broken line circle 16-16 in FIG. 15. As FIG. 16 shows, the second groove 94 further has a second location 120 of the groove bottom 107 that defines the location of maximum depth $D_2$ of the groove 94. This portion of the groove 94 also has a wedge shape that is defined by a first upper groove sidewall 122 and a second lower groove sidewall 124 and forms a first angle $\beta_2$. Preferably, the first angle $\beta_2$ is substantially within a range of about 15° to about 45° and more preferably substantially within a range of about 20° to about 40°.

The first upper groove sidewall 122 is connected to the groove bottom 107 by a first concave fillet 126 and to an outer portion of the sidewall by a second convex fillet 128. The first concave fillet 126 has an sixth average radius of curvature $R_{13}$ and the second convex fillet 128 has a fifth average radius of curvature $R_{14}$.

Preferably, a ratio $R_{13}/D_2$ of the sixth radius $R_{13}$ to the maximum depth $D_2$ is substantially within a range of about 0.05 to about 0.6, more preferably substantially within a range of about 0.10 to about 0.5 and most preferably substantially within a range of about 0.15 to about 0.4.

A ratio $R_{14}/D_2$ of the fifth radius $R_{14}$ to the maximum depth $D_2$ is preferably substantially within a range of about 0.1 to about 0.6, more preferably substantially within a range of about 0.2 to about 0.5 and most preferably substantially within a range of about 0.3 to about 0.4.

Preferably, a ratio $D_1/D_2$ of the minimum depth $D_1$ to the maximum depth $D_2$ is substantially within a range of about 0.1 to about 0.9, more preferably substantially within a range of about 0.2 to about 0.8 and most preferably substantially within a range of about 0.35 to about 0.65.

A ratio $D_1/D_{MAX}$ of the minimum depth $D_1$ to the maximum lateral dimension $D_{MAX}$ of the container 80 is preferably substantially within a range of about 0.005 to about 0.10, more preferably substantially within a range of about 0.008 to about 0.08 and most preferably substantially within a range of about 0.010 to about 0.04.

A ratio $D_2/D_{MAX}$ of the maximum depth $D_2$ to the maximum lateral dimension $D_{MAX}$ is preferably substantially within a range of about 0.01 to about 0.20, more preferably substantially within a range of about 0.015 to about 0.16 and most preferably substantially within a range of about 0.02 to about 0.08.

Preferably, a ratio of the first concave radius $R_{11}$ to the minimum depth $D_1$ is substantially within a range of about 0.15 to about 0.65, more preferably substantially within a range of about 0.25 to about 0.55 and most preferably substantially within a range of about 0.35 to about 0.45.

In addition, a ratio of the second convex radius $R_{12}$ to the minimum depth $D_1$ is preferably substantially within a range of about 0.4 to about 1.0, more preferably substantially within a range of about 0.5 to about 0.9 and most preferably substantially within a range of about 0.6 to about 0.8.

As FIG. 14 shows, the container 80 further has a first width $W_1$ defined at the location of the first groove 92 and a second width $W_2$ defined at the location of the second groove 94. Preferably, a ratio $R_7/W_1$ of the of the average radius of curvature $R_7$ of the substantially convex portion 102 of the flute 100 to the first width $W_1$ is substantially within a range of about 0.1 to about 0.15, more preferably substantially within a range of about 0.12 to about 0.2 and most preferably substantially within a range of about 0.14 to about 0.18.

In addition, a ratio $R_8/W_1$ of the average radius of curvature $R_8$ of the substantially concave portion 104 of the flute 100 to the first width $W_1$ is substantially within a range of about 0.02 to about 0.05, more preferably substantially within a range of about 0.025 to about 0.045 and most preferably substantially within a range of about 0.03 to about 0.04.

In the preferred embodiment, a ratio $R_9/W_2$ of the average radius of curvature $R_9$ of the substantially convex portion 106 of the flute 101 within the second groove 94 to the second width $W_2$ is substantially the same as the ratio $R_7/W_1$. The ratio $R_{10}/W_2$ of the average radius of curvature $R_{10}$ of the substantially concave portion 107 of the flute 101 to the second width $W_2$ is substantially the same as the ratio $R_8/W_1$.

Figure 17:
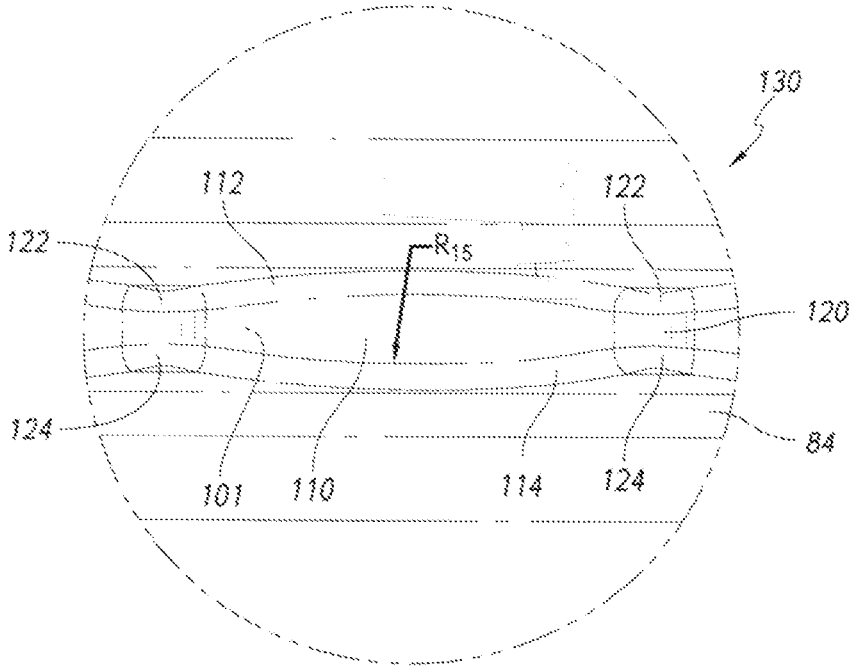
FIG. 17 is an enlarged view of a portion of the container that is indicated by broken line circle 17-17 in FIG. 14.

FIG. 17 is an enlarged portion of the sidewall shown in FIG. 14 including a portion of the groove 94. As FIG. 17 shows, the intersection between the flute 110 and the upper groove sidewall 112 as viewed in side elevation has a convex curvature that has a fourth average radius of curvature $R_{15}$. Preferably, a ratio $R_{15}/D_{MAX}$ of the fourth radius of curvature $R_{15}$ to the maximum lateral dimension $D_{MAX}$ of the container 80 is substantially within a range of about 0.5 to about 1.0, more preferably substantially within a range of about 0.08 to about 0.7 and most preferably substantially within a range of about 0.12 to about 0.4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a sidewall defining a bottom portion, a main body portion and an upper rim, the main body portion of the sidewall having at least one groove defined therein having a circumferential component; and reinforcement structure provided on the portion of the sidewall that defines the groove for limiting vertical expansion and contraction of the main body portion in response to force that is applied to the sidewall.

2. A plastic container according to claim 1, wherein the reinforcement structure comprises a plurality of flutes provided on the portion of the sidewall that defines the groove, each of the flutes having a vertical component.

3. A plastic container according to claim 2, wherein each of the flutes is oriented so as to be substantially vertical.

4. A plastic container according to claim 2, wherein the plurality of flutes are spaced substantially evenly about a circumference of the groove.

5. A plastic container according to claim 1, wherein the groove extends about an entire circumference of the container.

6. A plastic container according to claim 1, wherein the at least one groove comprises two grooves defined in the main body portion of the sidewall, each of the two grooves extending about an entire circumference of the main body portion, the two grooves being vertically spaced with respect to each other.

7. A plastic container according to claim 6, wherein a first groove of the two grooves is positioned substantially at a minimum width of the main body portion.

8. A plastic container according to claim 1, wherein the groove has a minimum depth and a maximum depth, and a ratio of the minimum depth to the maximum depth is substantially within a range of about 0.1 to about 0.9.

9. A plastic container according to claim 8, wherein the ratio of the minimum depth to the maximum depth is substantially within a range of about 0.2 to about 0.8.

10. A plastic container according to claim 9, wherein the ratio of the minimum depth to the maximum depth is substantially within a range of about 0.35 to about 0.65.

11. A plastic container according to claim 1, wherein the container has a maximum lateral dimension and the groove has at least one location having a minimum depth and at least one location having a maximum depth, with the location of minimum depth having a groove bottom as viewed in longitudinal cross-section, a first upper groove sidewall that is angled with respect to the groove bottom at a first angle and connected to the groove bottom by a first fillet having a first radius, with the first upper groove sidewall connected to an outer sidewall portion by a second fillet having a second radius.

12. A plastic container according to claim 11, wherein a ratio of the minimum depth to the maximum lateral dimension is substantially within a range of about 0.005 to about 0.10.

13. A plastic container according to claim 12, wherein the ratio of the minimum depth to the maximum lateral dimension is substantially within a range of about 0.008 to about 0.08.

14. A plastic container according to claim 13, wherein the ratio of the minimum depth to the maximum lateral dimension is substantially within a range of about 0.010 to about 0.04.

15. A plastic container according to claim 11, wherein a ratio of the first radius to the minimum depth is substantially within a range of about 0.15 to about 0.65.

16. A plastic container according to claim 15, wherein the ratio of the first radius to the minimum depth is substantially within a range of about 0.25 to about 0.55.

17. A plastic container according to claim 16, wherein the ratio of the first radius to the minimum depth is substantially within a range of about 0.35 to about 0.45.

18. A plastic container according to claim 11, wherein a ratio of the second radius to the minimum depth is substantially within a range of about 0.4 to about 1.0.

19. A plastic container according to claim 18, wherein the ratio of the second radius to the minimum depth is substantially within a range of about 0.5 to about 0.9.

20. A plastic container according to claim 19, wherein the ratio of the second radius to the minimum depth is substantially within a range of about 0.6 to about 0.8.

21. A plastic container according to claim 1, wherein the container has a maximum lateral dimension and wherein the reinforcement structure comprises a plurality of flutes and the groove includes an upper groove sidewall and a lower groove sidewall, and wherein an intersection between the flute and the upper groove sidewall as viewed in side elevation has a convex curvature that has a radius of curvature, and wherein a ratio of the radius of curvature to the maximum lateral dimension is substantially within a range of about 0.05 to about 1.0.

22. A plastic container according to claim 21, wherein the ratio of the radius of curvature to the maximum lateral dimension is substantially within a range of about 0.08 to about 0.7.

23. A plastic container according to claim 22, wherein the ratio of the radius of curvature to the maximum lateral dimension is substantially within a range of about 0.12 to about 0.4.

24. A plastic container according to claim 11, wherein the groove has a second lower groove sidewall that together with the upper groove sidewall defines a wedge that is angled with respect to the groove bottom at a wedge angle that is substantially within a range of about 15° to about 45°.

25. A plastic container according to claim 24, wherein the wedge angle is substantially within a range of about 20° to about 40°.

26. A plastic container according to claim 1, wherein the container has a maximum lateral dimension and the groove has at least one location having a minimum depth and at least one location having a maximum depth, with the location of maximum depth having a groove bottom as viewed in longitudinal cross-section, a first upper groove sidewall that is angled with respect to the groove bottom at a second angle and connected to the groove bottom by a first fillet having a first radius, with the first upper groove sidewall connected to an outer sidewall portion by a second fillet having a second radius.

27. A plastic container according to claim 26, wherein a ratio of the maximum depth to the maximum lateral dimension is substantially within a range of about 0.01 to about 0.20.

28. A plastic container according to claim 27, wherein the ratio of the maximum depth to the maximum lateral dimension is substantially within a range of about 0.015 to about 0.16.

29. A plastic container according to claim 28, wherein the ratio of the maximum depth to the maximum lateral dimension is substantially within a range of about 0.02 to about 0.08.

30. A plastic container according to claim 26, wherein a ratio of the first radius to the maximum depth is substantially within a range of about 0.05 to about 0.6.

31. A plastic container according to claim 30, wherein the ratio of the first radius to the maximum depth is substantially within a range of about 0.10 to about 0.5.

32. A plastic container according to claim 31, wherein the ratio of the first radius to the maximum depth is substantially within a range of about 0.15 to about 0.4.

33. A plastic container according to claim 26, wherein a ratio of the second radius to the maximum depth is substantially within a range of about 0.1 to about 0.6.

34. A plastic container according to claim 33, wherein the ratio of the second radius to the maximum depth is substantially within a range of about 0.2 to about 0.5.

35. A plastic container according to claim 34, wherein the ratio of the second radius to the maximum depth is substantially within a range of about 0.3 to about 0.4.

36. A plastic container according to claim 26, wherein the groove is further defined by a first upper groove surface that together with a second lower groove surface forms a wedge shape that defines a wedge angle that is substantially within a range of about 15° to about 45°.

37. A plastic container according to claim 36, wherein the wedge angle is substantially within a range of about 20° to about 40°.

* * * * *